US008010290B2

(12) United States Patent
Illfelder

(10) Patent No.: US 8,010,290 B2
(45) Date of Patent: Aug. 30, 2011

(54) METHOD OF OPTIMIZING A WELL PATH DURING DRILLING

(75) Inventor: Herbert M. J. Illfelder, Houston, TX (US)

(73) Assignee: Smith International, Inc., Houston, TX (US)

( * ) Notice: Subject to any disclaimer, the term of this patent is extended or adjusted under 35 U.S.C. 154(b) by 716 days.

(21) Appl. No.: 12/150,997

(22) Filed: May 2, 2008

(65) Prior Publication Data

US 2008/0275648 A1 Nov. 6, 2008

Related U.S. Application Data

(60) Provisional application No. 60/927,455, filed on May 3, 2007.

(51) Int. Cl.
*G01V 1/40* (2006.01)

(52) U.S. Cl. ..... 702/7

(58) Field of Classification Search ..... 702/7
See application file for complete search history.

(56) References Cited

U.S. PATENT DOCUMENTS

| | | | |
|---|---|---|---|
| 3,725,777 | A | 4/1973 | Robinson et al. |
| 4,072,200 | A | 2/1978 | Morris et al. |
| 4,458,767 | A | 7/1984 | Hoehn, Jr. |
| 4,465,140 | A | 8/1984 | Hoehn, Jr. |
| 5,485,089 | A | 1/1996 | Kuckes |
| 5,512,830 | A | 4/1996 | Kuckes |
| 5,541,517 | A | 7/1996 | Hartmann et al. |
| 5,589,775 | A | 12/1996 | Kuckes |
| 5,657,826 | A | 8/1997 | Kuckes |
| 5,675,488 | A | 10/1997 | McElhinney |
| 5,923,170 | A | 7/1999 | Kuckes |
| 6,369,679 | B1 | 4/2002 | Cloutier et al. |
| 6,698,516 | B2 | 3/2004 | Van Steenwyk et al. |
| 6,991,045 | B2 | 1/2006 | Vinegar et al. |
| 7,080,460 | B2 | 7/2006 | Illfelder |
| 7,321,293 | B2 | 1/2008 | Kennedy et al. |
| 7,886,844 | B2 * | 2/2011 | Phillips ..... 175/24 |
| 2005/0150689 | A1 | 7/2005 | Pushkar et al. |

FOREIGN PATENT DOCUMENTS

| | | |
|---|---|---|
| CA | 2279539 | 12/2000 |
| EP | 0301671 B1 | 2/1989 |
| WO | WO95/19490 | 7/1995 |

OTHER PUBLICATIONS

A.G. Nekut, A.F. Kuckes, and R.G. Pitzer, "Rotating magnet ranging—a new drilling guidance technology," 8th One Day Conference on Horizontal Well Technology.

(Continued)

*Primary Examiner* — Aditya Bhat

(57) ABSTRACT

A method for determining a list of survey points for a drilling well includes a feedback loop in which one or more measured parameters are compared with computed or derived parameters. The computed parameters are typically obtained from other/additional measurements. For example, in one exemplary embodiment of the invention, a magnetic least distance vector determined via magnetic ranging is compared with a geometric least distance vector computed from conventional borehole surveying measurements. Estimates of the drilling well azimuth and/or inclination may be adjusted to yield a good agreement between the magnetic and geometric least distance vectors. Exemplary embodiments of the present invention advantageously provide for a substantially real-time determination of a definitive well path for a drilling well as well as a substantially real-time relative placement of the drilling well with respect to a target well.

26 Claims, 6 Drawing Sheets

OTHER PUBLICATIONS

Canadian Sections SPE/Petroleum Society, Nov. 7, 2001.
J.I. de Lange and T.J. Darling, "Improved detectability of blowing wells," SPE Drilling Engineering, Mar. 1990.
T. L. Grills, "Magnetic ranging technologies for drilling steam assisted gravity drainage well pairs and unique well geometries—A comparison of Technologies,".
SPE/Petroleum Society of CIM/CHOA 79005, 2002.
E.J. Stockhausen and W.G. Lesso, Jr., "Continuous direction and inclination measurements lead to an improvement in wellbore positioning," SPE/IADC 79917, 2003.

* cited by examiner

METHOD OF OPTIMIZING A WELL PATH DURING DRILLING

RELATED APPLICATIONS

This application claims the benefit of U.S. Provisional Application Ser. No. 60/927,455 entitled Well Path Optimization Between a Drilling Well and a Magnetized Target Well, filed May 3, 2007.

FIELD OF THE INVENTION

The present invention relates generally to drilling and surveying subterranean boreholes such as for use in oil and natural gas exploration. In one exemplary embodiment, this invention relates to a method for determining the well path of a drilling well using magnetic ranging measurements from a magnetized target well.

BACKGROUND OF THE INVENTION

In conventional borehole surveying, borehole inclination and azimuth (which, together, essentially define a vector or unit vector tangent to the borehole) are determined at a discrete number of longitudinal points along the borehole (e.g., at an approximately defined measured depth interval). Typically, no assumptions are required about the trajectory of the borehole between the discrete measurement points to determine inclination and azimuth. The discrete measurements are then assembled into a survey of the well and used to calculate a three-dimensional well path (e.g., using the minimum curvature assumption). The use of accelerometers, magnetometers, and gyroscopes are well known in such conventional borehole surveying techniques for measuring borehole inclination and/or azimuth. For example, borehole inclination is commonly derived from tri-axial accelerometer measurements of the earth's gravitational field. Borehole azimuth is commonly derived from tri-axial magnetometer measurements of the earth's magnetic field.

In making conventional borehole azimuth measurements it is assumed (i) that the actual (nominal) magnetic field of the earth is known and (ii) that the downhole tool measures only this field. Standard practice makes both assumptions. However, it is known that both assumptions are sometimes violated. Depending upon the measurement accuracy required, violation of these assumptions can be problematic. For example, the Earth's magnetic field (both the magnitude and direction of the field) is known to vary in time. Thus the actual magnetic field may not be known with sufficient accuracy. Where such variation is significant, standard practice is to use magnetic field measurements (or measurements of the variations) made at established observatories. On-site measurements of the Earth's field are sometimes also utilized; however, obtaining reliable on-site measurements can be problematic (due to the presence of magnetic interference at the rig site).

The assumption that the tool measures only the Earth's magnetic field is violated in the presence of magnetic interference. Such interference is known to cause errors in the calculated borehole azimuth values. The bottom hole assembly (BHA) itself is one common source of such magnetic interference. Motors and stabilizers (and other BHA components) used in directional drilling applications are typically permanently magnetized during magnetic particle inspection processes. BHA interference can be estimated or measured and is commonly subtracted from the magnetic field measurements. BHA interference can also be reduced through proper tool design.

Magnetic interference is also commonly encountered in close proximity to subterranean magnetic structures, such as cased well bores, or ferrous minerals in formations or ore bodies. Techniques are known in the art for using magnetic field measurements to locate subterranean magnetic structures, such as a nearby cased borehole. These techniques are sometimes used, for example, in well twinning applications in which one well (referred to as a twin well or a drilling well) is drilled in close proximity and often substantially parallel to another well (commonly referred to as a target well).

In co-pending, commonly assigned, U.S. patent application Ser. No. 11/301,762 to McElhinney, a technique is disclosed in which a predetermined magnetic pattern is deliberately imparted to a plurality of casing tubulars. These tubulars, thus magnetized, are coupled together and lowered into a target well to form a magnetized section of casing string typically including a plurality of longitudinally spaced pairs of opposing magnetic poles. Magnetic ranging measurements may then be advantageously utilized to survey and guide drilling of a twin well relative to the target well. For example, the distance between the twin and target wells may be calculated using magnetic field strength measurements made in the twin well. This well twinning technique may be used, for example, in steam assisted gravity drainage (SAGD) applications in which horizontal twinned wells are drilled to enhance recovery of heavy oil from tar sands.

While the above described method of magnetizing wellbore tubulars has been successfully utilized in well twinning applications, there is room for yet further improvement. For example, the output of the above described magnetic ranging methodology is in the form of a distance and a direction between the drilling and target wells rather than a definitive survey of the drilling well (from which a definitive well path may be derived). Moreover, in certain drilling conditions, there can be considerable noise in the magnetic ranging measurements, e.g., due to fluctuations in the measured magnetic field strength and the removal (subtracting) of the earth's magnetic field from the measured magnetic field. Such noise can result in uncertainties in the distance and direction between the twin and target wells. In SAGD operations, in which the distance and direction between the two wells must be maintained within predetermined limits, the uncertainties are at times unacceptable.

There is a need in the art for improved surveying methodologies, and in particular, methodologies that generate a three-dimensional survey of the well being drilled. There is also a need for improved magnetic surveying methods, particularly magnetic ranging methods applicable to SAGD twin well drilling operations.

SUMMARY OF THE INVENTION

Exemplary aspects of the present invention are intended to address the above described need for improved surveying methodologies. Exemplary embodiments of the invention include a method for determining a list of survey points (from which a well path may be derived) for a drilling well. Methods in accordance with the invention include a feedback loop in which one or more measured parameters are compared with computed or derived parameters. The computed parameters are typically obtained from other/additional measurements. For example, in one exemplary embodiment of the invention, a magnetic least distance vector determined via magnetic ranging is compared with a geometric least distance vector computed from conventional borehole surveying measurements. Estimates of the drilling well azimuth and/or inclination may be adjusted to yield a good agreement (i.e., a good fit with minimal difference) between the magnetic and geometric least distance vectors.

Exemplary embodiments of the present invention provide several advantages over prior art surveying techniques. For example, in well twinning applications, exemplary embodiments of this invention provide for a substantially real-time determination of a definitive well path for the drilling well as well as a substantially real-time relative placement of the drilling well with respect to the target well (in the form of magnetic and geometric least distance vectors). Moreover, exemplary embodiments of the invention advantageously minimize the noise inherent in the magnetic ranging measurements.

In one aspect, the present invention includes a method for obtaining a list of survey points for a subterranean borehole while drilling. The list of survey points defines a well path and includes a plurality of survey points at a corresponding plurality of measured depths. Each survey point includes at least one of a borehole inclination and a borehole azimuth. The method includes deploying a drill string in a drilling well, the drill string including at least one survey sensor, and estimating at least one of a borehole inclination and a borehole azimuth of the drilling well. First and second comparable quantities are acquired. The first and second quantities are derived using different considerations. The first quantity is derived using the estimate of the borehole inclination and/or the borehole azimuth. The first and second comparable quantities are then compared to one another to obtain an error signal. At least one of the borehole inclination and the borehole azimuth are adjusted to obtain a survey point. The survey point is selected so that a difference between the comparable quantities is less than a predetermined threshold. The survey point is then recorded in the list of survey points.

In another aspect the present invention includes a method for determining a list of survey points for a drilling well based on magnetic ranging measurements of magnetic flux emanating from a target well. The target well is magnetized such that it includes a substantially periodic pattern of opposing north-north (NN) magnetic poles and opposing south-south (SS) magnetic poles spaced apart along a longitudinal axis thereof. The method includes deploying a drill string in the drilling well, the drill string including a magnetic sensor in sensory range of magnetic flux emanating from the target well, and estimating a borehole inclination and a borehole azimuth of the drilling well. The borehole inclination and the borehole azimuth estimates are processed to calculate a modeled magnetic field at the magnetic sensor. A magnetic field is also measured with the magnetic sensor. At least one of the borehole inclination and the borehole azimuth estimates are adjusted to obtain a survey point. The survey point is selected so that a difference between the modeled magnetic field and the measured magnetic field is less than a predetermined threshold. The survey point is then recorded in the list of survey points.

The foregoing has outlined rather broadly the features and technical advantages of the present invention in order that the detailed description of the invention that follows may be better understood. Additional features and advantages of the invention will be described hereinafter, which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

Figure 1:
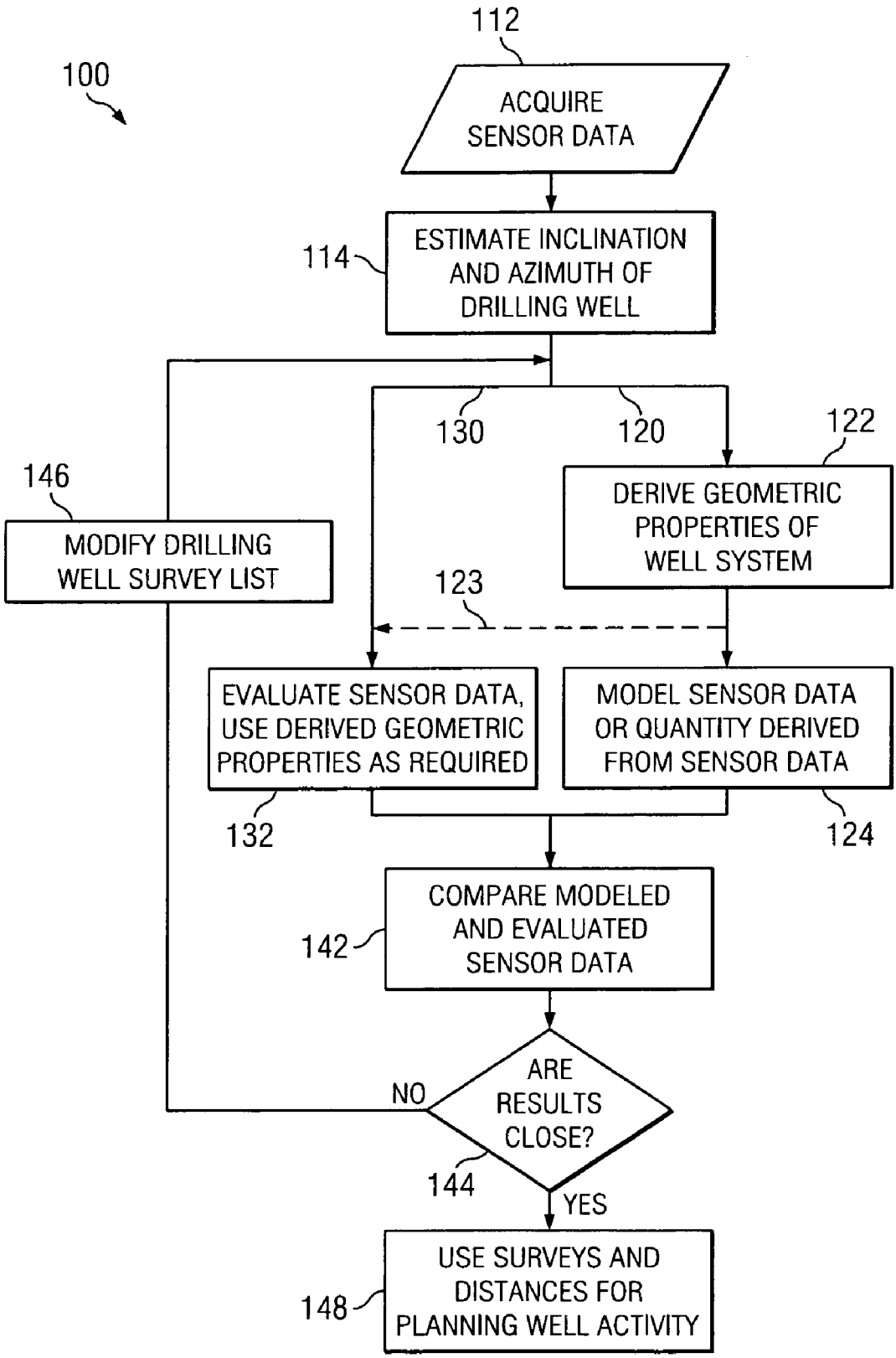
FIG. 1 depicts a flow chart of a general method embodiment in accordance with the present invention.

With reference now to FIG. 1, a general embodiment 100 of the present invention is depicted in flow chart form. As shown, the invention includes acquiring data at 112 and making a preliminary estimate of the inclination and azimuth of a drilling well 114 (e.g., using sensor data acquired at 112). Such data may include conventional sensor data or other information relevant to the well path of the drilling well. Steps 112 and 114 are conventional surveying steps and may include standard deterministic/systemic corrections that take into account, for example, BHA magnetic interference and/or errors in the Earth's magnetic field. Pathfinder Energy Services Mac3® represents one such correction algorithm.

With continued reference to FIG. 1, at step 122 (in path 120) geometric properties of the well system are derived based upon the inclination and azimuth estimated in step 114 (as well as previous survey points). In one exemplary embodiment, a well path may be computed based upon a plurality of survey points (including the estimates obtained in 114) using the minimum curvature assumption. Predicted sensor data and/or quantities derived from the sensor data may then modeled in step 124 (based upon the well path computed in step 122). At step 132 (in path 130) the measured sensor data (from step 112) is evaluated. Derived geometric properties from step 122 may be utilized as required (as shown at 123). At step 142 the modeled quantities derived in step 124 and the evaluated/measured quantities derived in step 132 are compared to generate an error signal. If the error signal is greater than a predetermined threshold at 144, a feedback loop is executed. In executing the feedback loop, the drilling well survey list (the list of survey points) may be modified at step 146. Often it is only necessary to modify the most recently obtained inclination and azimuth (the estimate obtained at 114). However, substantially any or all of the inclination and azimuth values in the survey list may be modified to obtain a good fit between the measured and modeled quantities in 142 and 144.

The modification of the survey list in 146 may be manually or automatically implemented. After modification, steps 122, 124, 132, 142, and 144 are then repeated. If the error signal is within the predetermined threshold, the drilling well survey list (including the most recently estimated inclination and azimuth) is tentatively accepted (but may be changed based on future measurements). It will also be appreciated that there may be a-priori constraints placed on the modification of inclination and azimuth at step 146. For example, it is often advantageous to implement a constraint on the dogleg severity between successive survey points. Such a constraint may limit the dogleg severity to being greater than or less than some predetermined threshold or within a predetermined range. It will also be appreciated that a plurality of error signals may be utilized simultaneously (e.g., as shown on FIG. 5), a weighted average of which makes up a cumulative error signal. Moreover, certain error signals (or the interpretation of certain error signals) may be qualitative in nature (as opposed to strictly quantitative).

It will be appreciated that in a general sense the invention includes identifying and obtaining pairs of comparable quantities which are derived from different considerations. In our exemplary applications, the first of these quantities is derived in path 120 (FIG. 1) based on geometric properties of the drilling well (e.g., a list of survey points that define a physical well path). The second of these quantities is obtained in path 130, for example, via acquiring and/or processing sensor measurements. The invention further includes a feedback loop where the borehole azimuth and/or borehole inclination estimates are adjusted to achieve a minimal difference (a difference that is suitably low) between the pairs of comparable quantities.

Figure 2:
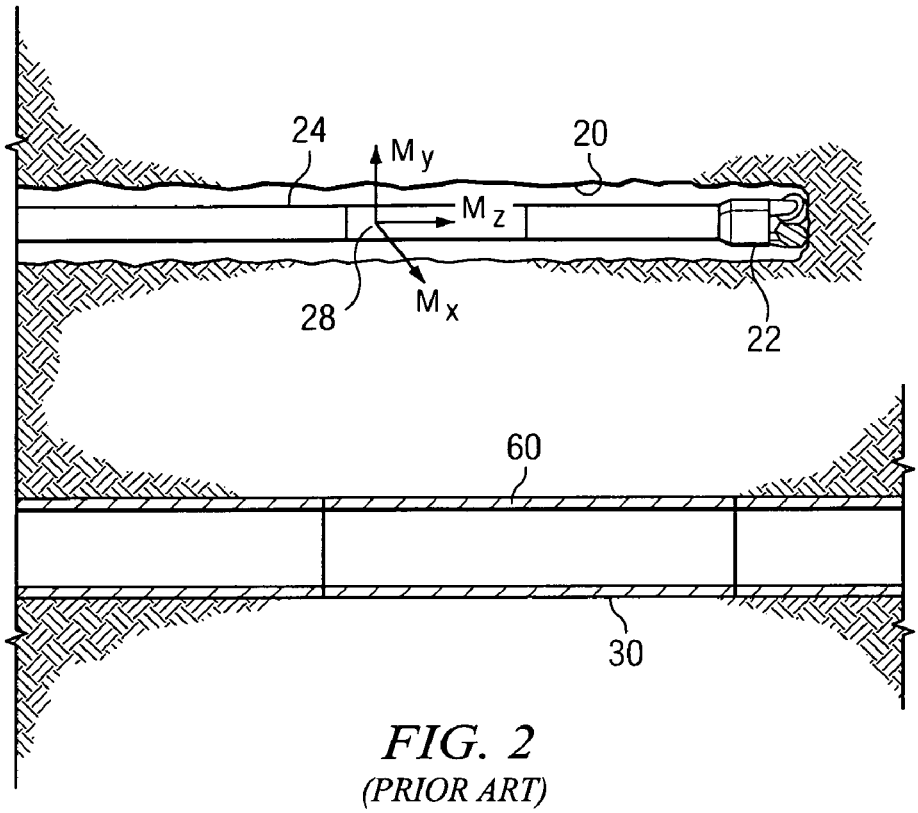
FIG. 2 (PRIOR ART)
FIG. 2 depicts a prior art arrangement for a SAGD well twinning operation.
Figure 3:
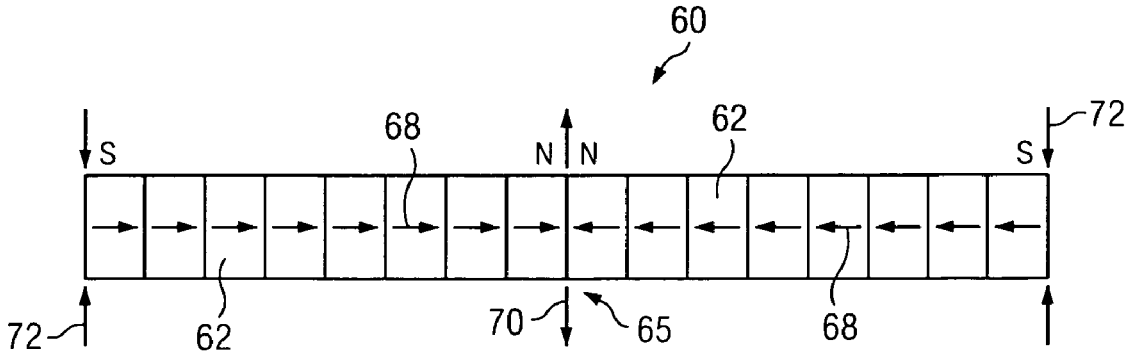
FIG. 3 (PRIOR ART)
FIG. 3 depicts a prior art magnetization of a wellbore tubular.
Figure 4:
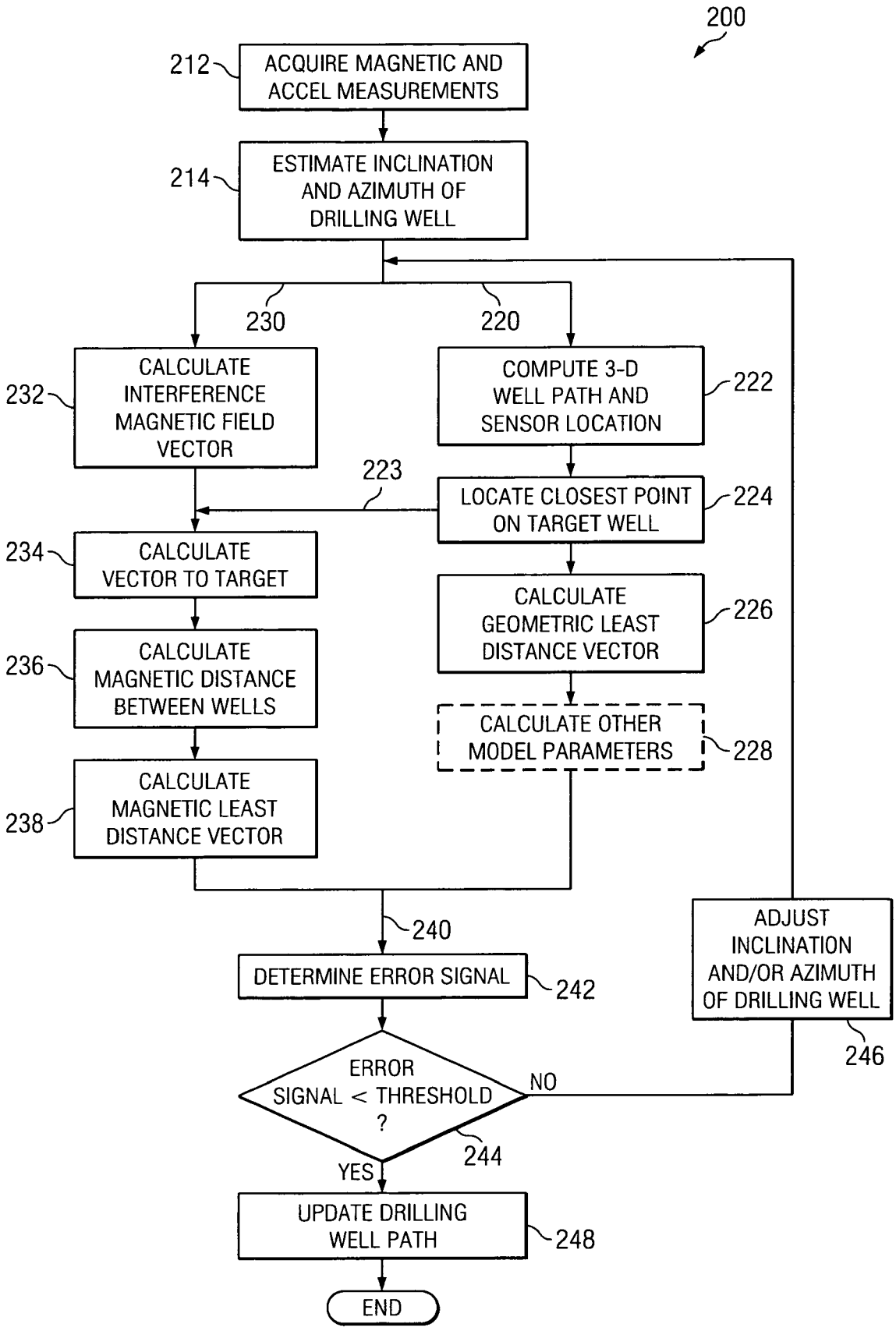
FIG. 4 depicts a flow chart of one exemplary method embodiment in accordance with the present invention.

Turning now to FIGS. 2-4, one exemplary embodiment in accordance with the invention is described in more detail. FIG. 2 schematically depicts a well twinning application such as a SAGD twinning operation (in which a twinned (parallel) well is drilled for enhanced oil production using Steam Assisted Gravity Drainage). A typical SAGD well twinning operation requires a horizontal injector 20 to be drilled a substantially fixed distance substantially directly above a horizontal portion of a producer 30 (e.g., not deviating more than about 1-2 meters up or down or to the left or right of the lower well). In this application, the upper well is commonly referred to as the injector while the lower well is referred to as the producer. In the exemplary embodiment shown, the lower borehole 30 is drilled first, for example, using conventional directional drilling and MWD techniques. In this exemplary embodiment, the lower well becomes the constraining or "target" and is therefore also referred to herein as the target well. The lower well is a target in the sense that the goal in drilling the upper well is placement of the drilling well substantially parallel and at a controlled distance above the pre-existing target well. The upper well is also referred to herein as a drilling well or a twin well. The invention is expressly not limited to embodiments in which the twin is above the target. The invention may be utilized for substantially any suitable parallel or approximately parallel orientation.

After drilling is completed, the target borehole 30 may be cased using a plurality of premagnetized tubulars (such as those shown on FIG. 3 described below). As described in co-pending, commonly assigned U.S. patent application Ser. No. 11/301,762, measurements of the magnetic field about the target well 30 may then be used to guide subsequent drilling of the twin well 20. In the exemplary embodiment shown, drill string 24 includes at least one tri-axial magnetic field measurement sensor 28 deployed in close proximity to the drill bit 22. Sensor 28 is used to measure the magnetic field as the twin well 20 is drilled and is used to infer information about the interfering magnetic field surrounding target well 30. Such magnetic field measurements are then utilized to guide continued drilling of the twin well 20 along a predetermined path relative to the target well 30. For example, as described in the '762 Patent Application, the distance between the twin 20 and target 30 wells may be determined (and therefore controlled) via such magnetic field measurements.

With reference now to FIG. 3, an exemplary tubular 60 magnetized as described in the '762 application is shown. The exemplary tubular 60 embodiment shown includes a plurality of discrete magnetized zones 62 (typically three or more). Each magnetized zone 62 may be thought of as a discrete cylindrical magnet having a north N pole on one longitudinal end thereof and a south S pole on an opposing longitudinal end thereof such that a longitudinal magnetic flux 68 is imparted to the tubular 60. Tubular 60 further includes a single pair of opposing north-north NN poles 65 at the midpoint thereof. The purpose of the opposing magnetic poles 65 is to focus magnetic flux outward from tubular 60 as shown at 70 (or inward for opposing south-south poles as shown at 72).

It will be appreciated that the present invention is not limited to the exemplary embodiments shown on FIGS. 2 and 3. For example, the invention is not limited to SAGD twinning applications. Rather, exemplary methods in accordance with this invention may be utilized to drill twin wells having substantially any relative placement for substantially any application. For example, embodiments of this invention may be utilized for river crossing applications (such as for underwater cable runs in which two wells are placed side by side at substantially the same depth). Moreover, the invention is not limited to any particular magnetization pattern or spacing of pairs of opposing magnetic poles on the target well. The invention may be utilized for target wells having a longitudinal magnetization (e.g., as shown on FIG. 3) and/or a transverse magnetization (e.g., as disclosed in co-pending, commonly assigned U.S. patent application Ser. No. 10/536,124—Filed Aug. 25, 2009). Nor is the invention limited to well twinning applications. The feedback mechanism described above with respect to FIG. 1 may be utilized in substantially any drilling operation to obtain a list of survey points for a well while drilling.

With continued reference to FIG. 2, exemplary embodiments of sensor 28 are shown to include three mutually orthogonal magnetic field sensors, one of which is oriented substantially parallel with the borehole axis ($M_Z$). Sensor 28 may thus be considered as determining a plane (defined by $M_X$ and $M_Y$) orthogonal to the borehole axis and a pole ($M_Z$) parallel to the borehole axis of the drilling well, where $M_X$, $M_Y$, and $M_Z$ represent measured magnetic field vectors in the x, y, and z directions. As described in more detail below, exemplary embodiments of this invention may only require magnetic field measurements along the longitudinal axis of the drill string 24 ($M_Z$ as shown on FIG. 2).

With reference now to FIG. 4, another exemplary method embodiment 200 in accordance with the present invention is shown in flow chart form. Method 200 is suitable for use in SAGD drilling applications. In the exemplary embodiment shown, magnetic field and gravitational field measurements are acquired at 212. Tri-axial (three-dimensional) measurements are typically acquired, e.g., via conventional survey sensors (conventional magnetometer and accelerometer sets) although the invention is not limited in this regard. At step 214, the magnetic field and gravitational field measurements are processed to estimate the inclination and azimuth of the twin well. An inclination angle is typically determined via accelerometer measurements acquired at 212 using algorithms known to those of ordinary skill in the art. A borehole azimuth angle may also be determined via known algorithms using the magnetic field and gravitational field measurements. However, as is also know to those of ordinary skill in the art, magnetic flux from a magnetized target well tends to interfere with conventional magnetic azimuth measurements. It may therefore be advantageous to estimate the borehole azimuth using and/or in combination with other techniques. For example, in well twinning operations, the azimuth of the twin well is typically relatively close to that of the target well (since the twin well is intended to essentially parallel the target well). Thus, the target well azimuth, e.g., as determined from conventional MWD or wireline surveys, may also be utilized as a first estimate of the twin well azimuth. The inclination and/or azimuth angles may also be estimated from an extrapolation of previously measured inclination and azimuth values. The invention is not limited in regards to the method by which the initial inclination and azimuth estimates are acquired.

Incorporating the estimate of the drilling well inclination and azimuth in the exemplary embodiment shown, a vector quantity defining the distance and direction between the drilling and target wells may be determined using each of two distinct, parallel paths 220 and 230. In path 220, a geometric least distance vector is determined from the calculated well paths of the drilling and target wells (using methods known to those skilled in the art). As described in more detail below, the drilling well path is calculated from the estimated survey (inclination and azimuth) data. In path 230, a magnetic least distance vector is determined from the magnetic field measurements (magnetic ranging measurements), for example, using techniques disclosed in commonly assigned U.S. patent application Ser. No. 11/799,906.

With continued reference to FIG. 4, one exemplary method (path 220) for determining the geometric least distance vector is described in more detail. At step 222, the latest estimate of the inclination and azimuth angles (initially acquired in step 214) is utilized, along with inclination and azimuth values from previous survey points, are to compute a three-dimensional well path for the drilling well. The location of the MWD sensors in the drilling well is then calculated from the well path (in three dimensions). At step 224, the three-dimensional location of the MWD sensors as determined in step 222 and the continuously derived well path of the target well are utilized to locate (in three dimensions) the closest point on the target well. The well path of the target well is typically available from target well surveys acquired during and/or after drilling thereof. At step 226, a geometric least distance vector between the drilling and target wells is calculated from the three dimensional locations determined in steps 222 and 224 (e.g., by subtracting the location of the MWD sensors in the drilling well (determined in step 222) from the location of the closest point on the target well (determined in step 224)). The geometric least distance vector defines both a distance and a direction between the drilling and target wells using known geometric techniques. When evaluating this least distance vector, the result is typically presented in the borehole reference frame. At step 228, other model parameters may be optionally calculated. For example, by considering the derived measured depth in the target well and the casing records of that well, the axial position of the drilling well relative to the nearest NN (or SS) pole on the target well may also be determined. For example, the three-dimensional location determined in step 224 may be compared with known NN pole locations to determine the axial distance to the nearest NN pole (and by extension to the nearest SS pole).

With continued reference to FIG. 4, an alternative exemplary method (path 230) for determining a least distance vector is described in more detail. This least distance vector is referred to herein as a magnetic least distance vector. At step 232, the measurements made in step 212 and the estimated inclination and azimuth angles obtained in step 214 are processed to determine a portion of the magnetic field measurement due to the target well (i.e., due to the target well magnetization). The magnetic field component due to the target well is referred to herein interchangeably as the remnant magnetic field and/or as the interference magnetic field vector. The interference magnetic field vector may be represented mathematically, for example, as follows:

$$\overline{M}_T=\overline{M}_M-\overline{M}_E \qquad \text{Equation 1}$$

where $\overline{M}_T$ represents the interference magnetic field vector, $\overline{M}_M$ represents the measured magnetic field vector, and $\overline{M}_E$ represents the earth's magnetic field vector. Performing the numerical action requires that the various vectors be transformed into the same coordinate system. In the exemplary method described herein, the borehole reference frame is utilized (although the invention is not limited in this regard). In this reference frame, after the application of tool specific magnetic corrections, the measured values of $M_X$ and $M_Y$ are rotated using the accelerometer determined toolface. The value of $M_Z$ remains unchanged by this action. Similarly, the earth's magnetic field, $M_E$, needs to be transformed into the borehole reference frame. This action requires usage of the estimates of both the inclination and azimuth of the tool (obtained in step 214 of FIG. 4).

The artisan of ordinary skill will readily recognize that in analyzing the magnetic field vectors in the vicinity of the target well it may also be necessary to subtract other magnetic field components from the measured magnetic field vectors. For example, as described above in the Background Section of this application, such other magnetic field components may be the result of magnetized components in the BHA. Techniques for accounting for such interference are well known in the art.

The magnetic field of the earth (including both magnitude and direction components) is typically known, for example, from previous geological survey data or a geomagnetic model. However, for some applications it may be advantageous to measure the magnetic field in real time on site at a location substantially free from magnetic interference, e.g., at the surface of the well or in a previously drilled well. Measurement of the magnetic field in real time is generally advantageous in that it accounts for time dependent variations in the earth's magnetic field, e.g., as caused by solar winds. However, at certain sites, such as an offshore drilling rig, measurement of the earth's magnetic field in real time may not be practical. In such instances, it may be preferable to utilize previous geological survey data in combination with suitable interpolation and/or mathematical modeling (i.e., computer modeling) routines.

The earth's magnetic field at the tool and in the coordinate system of the tool may be expressed mathematically, for example, as follows:

$$M_{ER}=H_E \cos D \sin Az$$

$$M_{EH}=H_E(\cos D \cos Az \cos Inc+\sin D \sin Inc)$$

$$M_{EZ}=H_E(\sin D \cos Inc-\cos D \cos Az \sin Inc) \qquad \text{Equation 2}$$

where $H_E$ is known (or measured as described above) and represents the magnitude of the earth's magnetic field, $M_{ER}$, $M_{EH}$, and $M_{EZ}$ represent the right side, high side and axial components of the earth's magnetic field in the borehole reference frame, and D, which is also known (or measured), represents the local magnetic dip. Inc and Az represent the inclination and azimuth (relative to magnetic north) of the borehole, which may be obtained, for example, as described above with respect to step 212.

At step 234, the direction from the drilling well to the target well may be found by determining the component of the interference magnetic field that is orthogonal to the direction of the target well. The orthogonal component of the interference magnetic field may be determined using conventional vector mathematical techniques. For example, a component of the interference vector magnetic field parallel to the target may be determined by multiplying a unit vector pointing in the direction of the target well with the dot product of the unit vector and the interference magnetic field vector. The orthogonal component may then be determined via subtracting the parallel component from the interference magnetic field vector. It will be appreciated that the orthogonal component of the interference magnetic field vector points in the same direction as the magnetic least distance vector. Thus a unit vector in the direction of the above described orthogonal component may be thought of as a "vector to target" (i.e., a three-dimensional direction) from the magnetic field sensor in the drilling well to the least distance point on the target well. This is owing to the fact that the interference magnetic field about the target well includes only axial and radial components (there is essentially no tangential component of the interference magnetic field).

As described above in FIG. 1 (and as shown at 223 in FIG. 4), derived geometric properties from path 220 may be utilized in path 230. In the exemplary embodiment shown on FIG. 4, step 234 utilizes the direction of the target well at the closest point determined in step 224. This direction may be obtained, for example, via interpolation of the target well path. Those of ordinary skill will recognize that the use of one or more geometric properties from path 220 results in a coupling of paths 220 and 230. Notwithstanding, in the exemplary embodiments described herein, it has been found that the coupling is sufficiently weak for the feedback mechanism to converge to a favorable solution.

At step 236, the interference magnetic field vector is processed to determine the distance between the drilling and target wells and optionally an axial position of the magnetic sensors relative to a magnetic NN (and/or SS) pole on the target well. This may be accomplished, for example, as disclosed in commonly assigned, co-pending U.S. patent application Ser. No. 11/799,906 to McElhinney et al. Briefly, the magnitude and flux angle (relative to the target well) of the interference magnetic field vector is determined. The flux angle may be determined, for example, from the ratio of the magnitudes of the parallel and orthogonal components of the interference magnetic field vector. The two values (magnitude and flux angle or the parallel and orthogonal components) are then matched to a mathematical model (either empirical or theoretical) of the magnetic flux about the target well to uniquely determine the magnetic distance and axial position of the measurement point of the drilling well relative to the target well.

At step 238, the magnetic direction determined in step 234 and the magnetic distance determined in step 236 are combined to create a magnetic least distance vector. The magnetic least distance vector is obtained, for example, via multiplying the magnetic distance with the vector to target (unit vector) determined in step 234.

With continued reference to FIG. 4, the geometric least distance vector and the magnetic least distance vector are processed in combination in path 240. At step 242, an "error signal" is determined via comparing at least one of numerous measures. For example, the magnetic distance and the magnetic direction (vector to target) determined in path 230 may be compared with the geometric distance and geometric direction determined in path 220. The error signal(s) (the differences between predetermined magnetic and geometric measures determined in paths 230 and 220 respectively) may then be compared with predetermined threshold(s) in step 244. If the error signal is greater than the threshold (i.e., the magnetic and geometric measures deviate by an unacceptable amount), then the estimated inclination and/or azimuth of the drilling well may be adjusted at step 246 prior to returning to paths 220 and 230 as shown. If the error signal is less than the threshold (i.e., the magnetic and geometric measures are sufficiently close), then the drilling well survey list may be updated at step 248 with the most recent inclination and azimuth angles (from step 214 or 246).

With reference to step 246 on FIG. 4, the borehole azimuth angle is typically the primary adjustable unknown in SAGD twinning embodiments (due to the magnetic interference which can result in errors in magnetic azimuth determination). Of course, the invention is not limited to merely adjustments in borehole azimuth. Furthermore it is typically advantageous to restrict inclination and azimuth adjustments in step 246 to those that maintain a physically meaningful well path. For example, the change in inclination (build rate) and the change in azimuth (turn rate) between successive survey points may be advantageously limited to meaningful values based on known drilling parameters (e.g., less than 5 degrees per hundred feet). The dogleg severity of the well path may also be restricted. It will be appreciated that it may also be necessary to adjust earlier survey points in the drilling well path to achieve a sufficiently close fit between the magnetic and geometric least distance vectors.

It will be understood that steps 244 and 246 on FIG. 4 may be executed manually or automatically. For example, a drilling operator may examine the error signal visually from a display (e.g., as shown on FIG. 5) and determine that the deviation between the magnetic and geometric measures is unacceptably high (step 244). The drilling operator may then manually enter adjusted azimuth and/or inclination values (step 246) prior to returning to paths 220 and 230. Of course, the feedback optimization shown on path 240 may also be automated via techniques known to those of ordinary skill in the art.

With continued reference to FIG. 4, it will be appreciated that the error signal in step 242 is not limited to magnetic and geometric measures of the least distance vector or the relative axial position between the two wells. Rather, the error signal may additionally (or alternatively) include numerous other measures. For example, as described above, the axial position of the drilling well with respect to the target well may be geometrically determined at step 228. The same parameter is commonly determined magnetically (from the magnetic ranging measurements) at step 236. The difference between these geometric and magnetic measures may constitute an additional (or alternative) error signal.

Additionally, in one exemplary alternative embodiment, path 220 may be extended to calculate an expected interference magnetic field vector from the geometric least distance vector determined in step 226, the axial position determined in step 228, and a mathematical model (either empirical or theoretical) of the magnetic flux emanating from the magnetized target well. The expected interference magnetic field vector may then be compared with the interference magnetic field vector calculated in step 232. In such an embodiment, the error signal is expressed as a deviation between the measured and geometrically calculated $\overline{M}_T$. As described above, the drilling well inclination and/or azimuth angles may be adjusted when the error signal is greater than a predetermined threshold. Alternatively, the earth's magnetic field may be added to the expected interference magnetic field vector in path 230 and the result transformed into the tool coordinate system. Expected interference from the BHA could be included. In such an embodiment, the error signal may be expressed as a deviation between the raw measured magnetic field vector and the predicted geometrically calculated values. It will be understood that the invention is not limited in these regards. The balance between comparing "raw" and "fully or partially modeled" results will be understood to be flexible. The comparison (in step 244) may be executed at any convenient point in the processing stream.

In one advantageous embodiment of the invention, the above described feedback mechanism may be utilized dynamically (in substantially real-time) during drilling. Those of ordinary skill in the art will appreciate that both magnetometer and accelerometer data may be sampled in substantially real-time during drilling (e.g., at approximately 30-60 second intervals). Such data is referred to herein as "dynamic" in distinction to conventional "static" measurements which are commonly made when the mud pumps are cycled off and a new drill string connection is being made (e.g., at 30 to 90 foot intervals in measured depth). In exemplary embodiments utilizing dynamic feedback, path 220 may be extended to calculate a predicted axial component of the magnetic field as a function of measured depth from the geometric least distance vector determined in step 226, an axial position determined in step 228, and a mathematical model (either empirical or theoretical) of the magnetic flux emanating from the magnetized target well. The predicted axial component may then be compared with dynamic measurements of the axial component of the magnetic field (e.g., $M_Z$) to generate a dynamic (substantially real-time) error signal during drilling. This dynamic error signal may then be utilized to provide dynamic feedback of the drilling well direction (azimuth and/or inclination) between survey points (e.g., at measured depth intervals of 2 feet or less). The feedback loop is typically performed in the same manner as described above with respect to path 240 in FIG. 4.

With further reference to FIG. 4, it will be appreciated that path 220 may also be extended to calculate an expected axial component of the gravitational field based on the inclination estimate in step 214. The predicted axial component of the gravitational field may then be compared with a dynamic measurement of the axial component of the gravitation field (dynamic z-axis accelerometer measurements) to generate another dynamic error signal. This dynamic error signal may then be utilized to provide dynamic feedback of the drilling well inclination between survey measurements (e.g., at measured depth intervals of 2 feet or less). Such feedback may be advantageously performed concurrently with previously described embodiments of the invention.

It will be understood that the inventive method is not limited to any particular magnetic (active and/or passive ranging) technique in path 230 for calculating the magnetic least distance vector (or the magnetic distance and direction) between the drilling and target wells. For example, the techniques disclosed in commonly assigned U.S. Pat. No. 6,985,814 to McElhinney may alternatively and/or additionally be utilized in path 230. Moreover, any of the magnetic distance determining techniques disclosed in commonly assigned, co-pending U.S. patent application Ser. No. 11/799,906 may likewise be utilized in path 230. For example, the '906 application discloses a technique in which substantially real-time measurements of the axial component of the magnetic field $M_Z$ (or the axial component of the interference magnetic field vector) are utilized to provide a substantially real-time estimate of the distance between the drilling and target wells.

Figure 5:
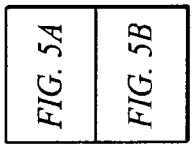
FIG. 5 depicts plots of various measured and modeled quantities versus measured depth for a SAGD drilling operation
Figure 5A:
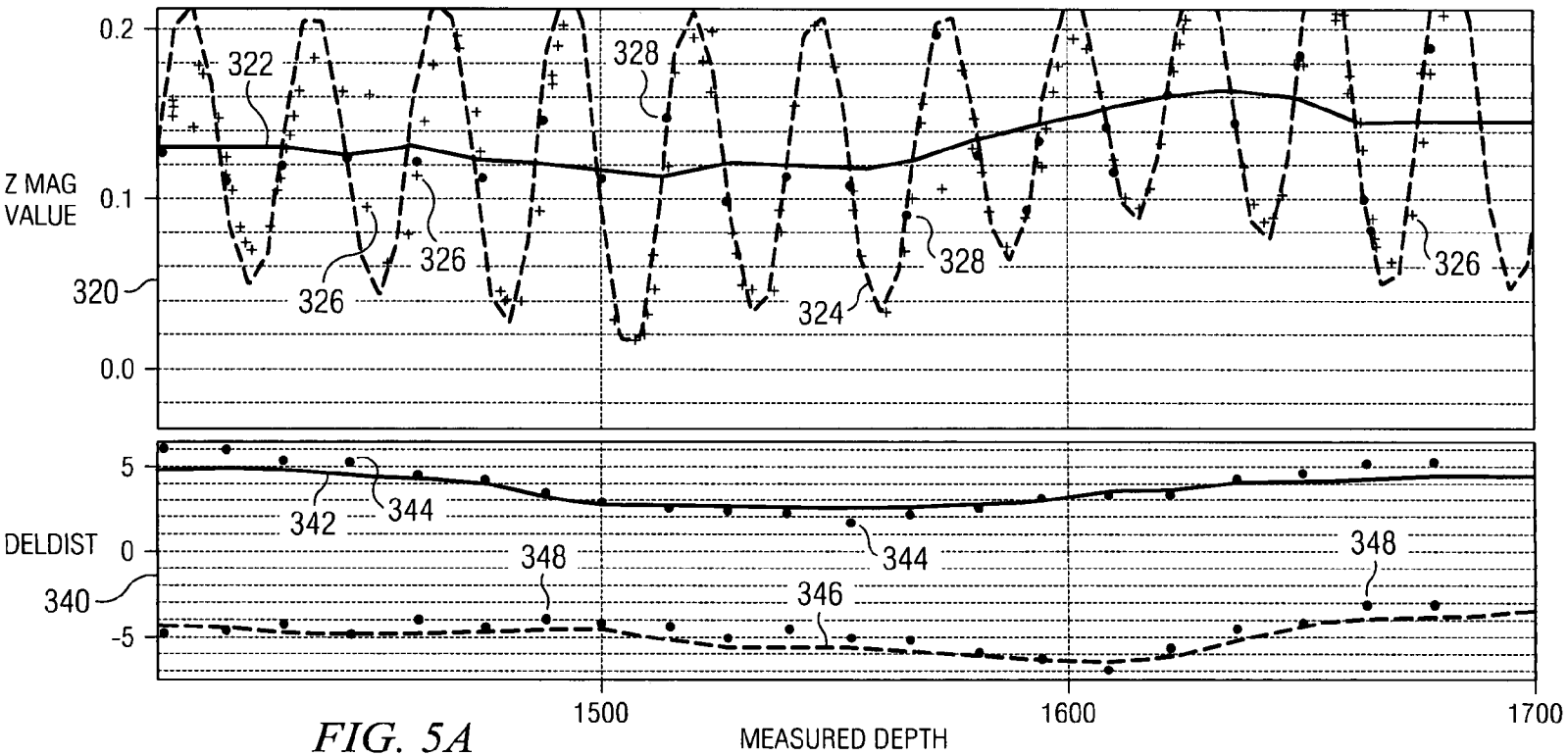
Figure 5B:
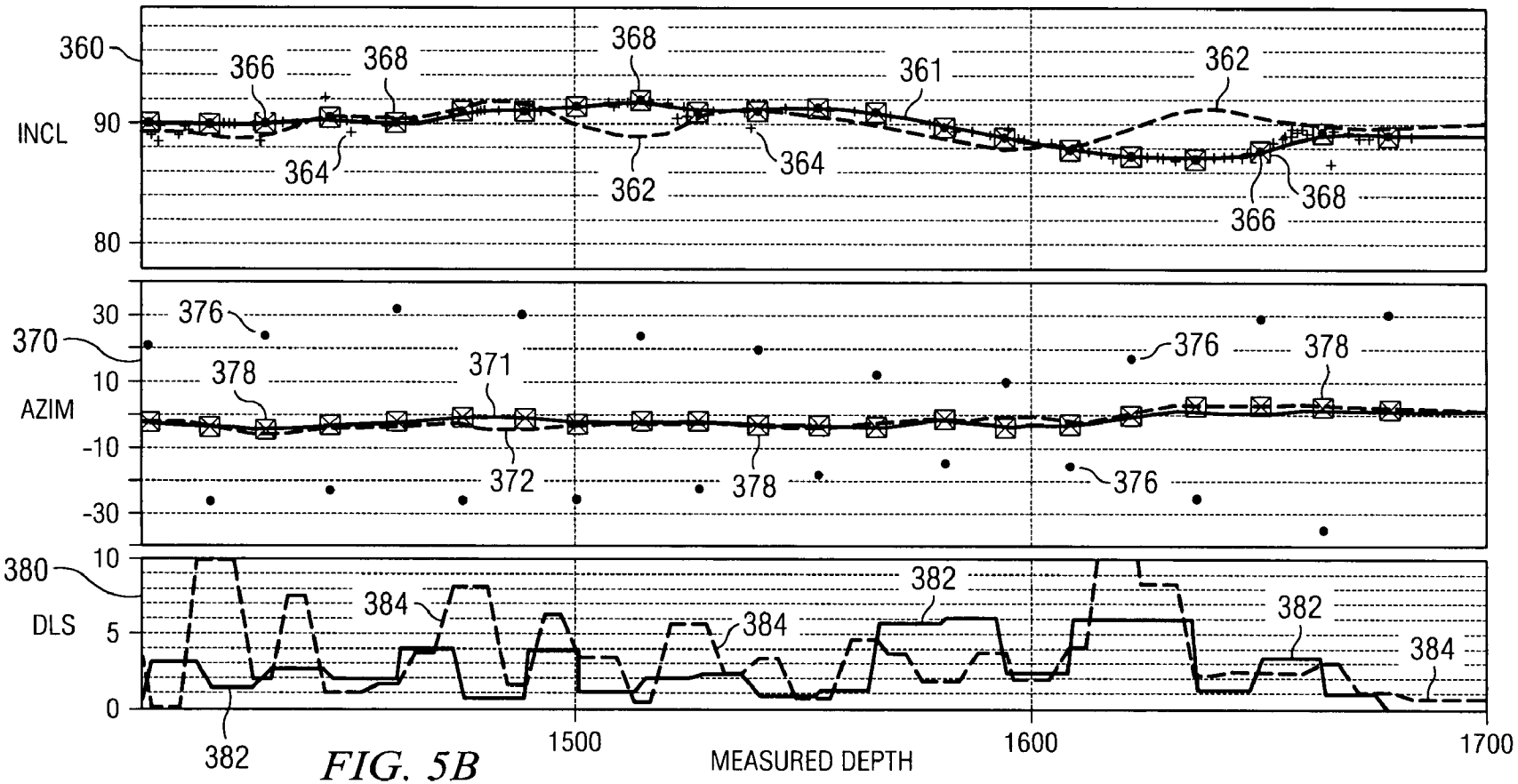

FIG. 5 illustrates a plot of various measured and modeled quantities versus measured depth used in an exemplary SAGD drilling operation. These measured and modeled quantities are utilized to implement the above describe feedback mechanism (e.g., in path 240 of FIG. 4). FIG. 5 depicts plots of five distinct parameters versus measured depth (at 320, 340, 360, 370, and 380 respectively). At 320, the axial component $M_Z$ of the magnetic field is plotted versus measured depth. Lines 322 and 324 depict predicted values based on the current well path estimate (e.g., determined in path 220 of FIG. 4). Line 322 predicts $M_Z$ in the absence of any magnetic interference (i.e., in the absence of a magnetized target well) and is thus determined solely from the computed well path of the drilling well which is derived from the list of survey points and the earth's magnetic field. Variation in $M_Z$ as a function of measured depth for line 322 is due entirely to changes in borehole direction (i.e., changes in borehole azimuth and borehole inclination). Line 324 models $M_Z$ in the presence of an expected target magnetization. Line 324 is determined from the computed well paths of both the drilling and target wells as well as a magnetic model of the remnant magnetic field about the target well (exemplary magnetic models are described in more detail in commonly assigned U.S. patent application Ser. No. 11/799,906). In the exemplary embodiment shown, line 324 is approximately periodic in nature (having a period of about 26-27 meters in measured depth). Dynamic measurements of $M_Z$ are represented by the '+' symbol as shown at 326. Static measurements of $M_Z$ (from static survey measurements made when the mud pumps are turned off) are represented by the '•' symbol as shown at 328.

One important feedback quantity in SAGD twinning operations is the difference between the magnetically derived least distance vector and the geometric derived least distance vector. The two vectors may be decomposed into right side and high side distances. With continued reference to FIG. 5, a plot of these two distances to the target well from the drilling well is shown at 340. Both geometrically and magnetically derived distances are shown. The geometrically derived distances are shown at lines 342 and 346 and are determined from the drilling and target well paths as described above with respect to path 220 of FIG. 4. The magnetically derived distances are represented by the '•' symbol as shown at 344 and 348. These measured distances are derived from the static survey data as described in more detail above with respect to path 230 of FIG. 4 (and in the '906 patent application).

FIG. 5 also plots borehole inclination and azimuth values of the drilling and target wells at 360 and 370 respectively. Lines 361 and 362 represent the modeled inclination values derived from the drilling and target well paths. As discussed above, the inclination and azimuth of both wells is used in the calculation of path 230. Additionally, the target well inclination may be used during drilling operations to allow the driller to lead changes in the target well for optimum well placement. Dynamic inclination measurements are represented by the '+' symbols as shown at 364. These may be obtained, for example, from axial accelerometer measurements made during drilling. Static inclination measurements are represented by the '•' symbol as shown at 366. Definitive survey points (obtained from the method of the present invention) are represented by the '□' symbol and are shown at 368. Lines 371 and 372 represent the geometrically derived azimuth values derived from the drilling and target well paths. Static azimuth measurements, made with the assumption that there is no magnetic interference, are represented by the '•' symbol as shown at 376. For this immediate application, the difference between the symbols shown at 376 and line 371 indicate the presence of magnetic interference. In the absence of magnetic interference, symbols 376 would be expected to approximately overlay line 371. Definitive survey points are represented by the '□' symbol and are shown at 378. A plot of DLS (dogleg severity) versus measured depth is shown at 380. These values are derived from the drilling and target definitive well paths (lines 382 and 384 respectively).

As described above with respect to FIG. 4, the present invention includes determining and minimizing at least one error signal (at 242) by comparing at least one pair of numerous measures. Determination of the error signal (or error signals) may be described in more detail with respect to FIG. 5. Numerous error signals suitable for use in exemplary embodiments of the invention are depicted in FIG. 5. For example, beginning at 340, the difference between the magnetic high side distance 344 and geometric high side distance 342 is a first error signal. The difference between the magnetic right side distance 348 and the geometric right side distance 346 provides another error signal. The error signal may be determined at only the most recent survey point (i.e., the survey point having the greatest measured depth) or for any plurality of survey points (at a corresponding plurality of measured depths). Thus minimizing the error signal (as described in FIG. 4) may be thought of as adjusting the inclination and/or azimuth estimates such that a "fit" is obtained between the modeled 342, 346 and measured 344, 348 distances over some predetermined range of measured depths. By "fit" it is meant that the modeled and measured parameters are sufficiently close so that the error signal is small. Those of ordinary skill will readily recognize that the successful application of this invention does not require a best fit (in the mathematical sense).

Additional suitable error signals are depicted at 320. For example, the difference between the static measurement(s) of $M_Z$ 328 and the predicted value(s) 324 represent another error signal. Although not shown in FIG. 5, differences between static measurements of $M_X$ and $M_Y$ and predicted values represent another error signal that may be utilized. Differences between the dynamic $M_Z$ measurements 326 and the predicted 324 represent yet another error signal. As described above, the error signals may be determined at the most recent survey point and/or simultaneously across any plurality of points (across any range of measured depths). Minimizing the error signal may advantageously include obtaining a fit between numerous measured and modeled parameters across a desired range of measured depths.

As described above, the build rate, turn rate, and/or dogleg severity of the drilling well may likewise be utilized to compute an error signal (dogleg severity is shown at 380 in FIG. 5). For example, the dogleg severity may be specified to be less than some predetermined value or within a certain predetermined range. In such embodiments, deviation from the predetermined specification may be considered an unacceptably large error signal. Correlation with known slide versus rotate segment intervals may be advantageously used to determine specified DLS ranges.

Figure 6:
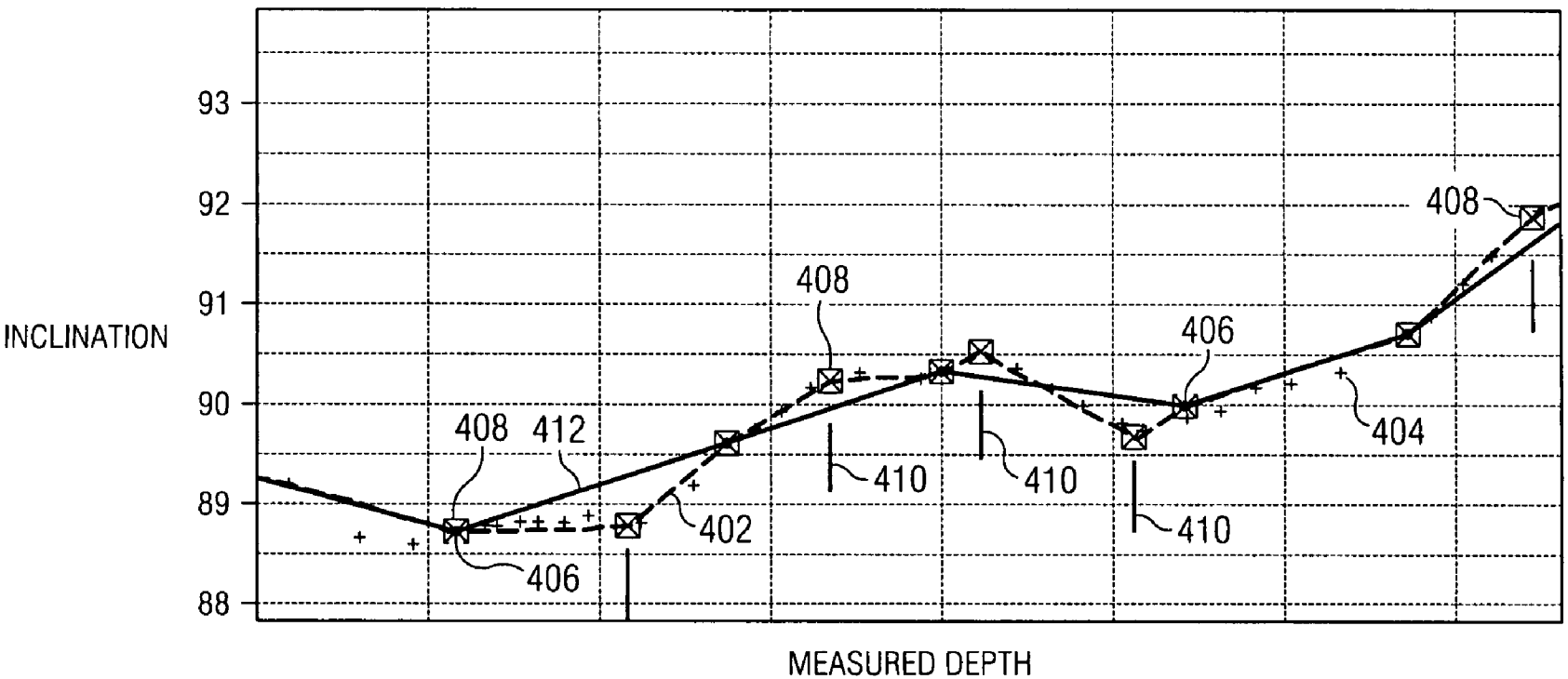
FIG. 6 depicts a plot of measured and modeled inclination versus measured depth.

As discussed by Stockhausen et al (see Stockhausen, et al., *Continuous Direction and Inclination Measurements Lead to an Improvement in Wellbore Positioning, SPE/IADC* 79917, 2003), the definition of an accurate well path may require surveys to be taken at critical points, in particular, where the drilling mode switches between rotating and sliding. FIG. 6 shows an example where dynamic accelerometer values may lead to the addition of additional dynamically derived surveys.

In most drilling operations, static surveys are not made at every slide/rotate transition point (or even at any such transition points). In applications in which there is no magnetic interference (or little as compared to SAGD twinning operations), one alternative embodiment of this invention may allow the determination of such intermediate surveys based on dynamic axial accelerometer and magnetometer measurements. In such an embodiment, measured and modeled quantities similar to those illustrated in FIG. 5 may be utilized to provide the necessary feedback. For example, a plot similar to that shown at 320 on FIG. 5 may be utilized. However, in the absence of magnetic interference, line 324 is removed (since it overlays line 322). An important feedback quantity in this embodiment is the fit between both the dynamic and static measurements (326 and 328) and the model shown at line 322. Plot 340 may be removed since there is no distance to a target well. Plot 360 does not display line 362, but otherwise functions identically with that previously discussed. Plot 370 does not display line 372 (since there is no target well). The azimuth values calculated from static measurements (shown at 376 in FIG. 5) would be expected to lie on (or near to) line 371. Finally, plot 380 does not display line 384 (again since there is no target well in this exemplary embodiment). Moreover, the dogleg severity calculated from the well path may advantageously be compared with drilling information, in particular, the slide/rotate transition points and may act as a secondary error signal. For example, a first predetermined range of dogleg severity values may be utilized for well segments drilled during sliding (e.g., a DLS between 4 and 6 degrees) and a second predetermined range of dogleg severity values may be utilized for well segments drilled during rotation (e.g., a DLS between 0 and 2 degrees). The effect of other drilling conditions (e.g., including drill bit rotation rate, weight on bit, and formation type) may also be considered when selecting ranges of dogleg severity values.

Operationally, surveys, specifying both inclination and azimuth measurements, may be added at slide/rotate transition points. The axial component of the magnetic field may be computed at these transition points and compared with the dynamic measurements. The inclination and/or azimuth values may be adjusted to improve the fit (i.e., minimize the error signal) between the predicted and measured values. Operationally, the inclination adjustment is often secondary as compared to the azimuth adjustment (as is also the case in the above described SAGD twinning embodiment).

FIG. 6 depicts one exemplary embodiment illustrating the use of an inclination based error signal. It will be appreciated that a magnetometer and/or azimuth based error signal may be similarly utilized (e.g., as described above with respect to FIG. 5). In the exemplary embodiment shown, borehole inclination is plotted versus measured depth. Dynamic inclination measurements are represented by the '+' symbols as shown at 404. Static inclination measurements are represented by the '•' symbol as shown at 406. Definitive survey points are represented by the '□' symbol and are shown at 408. Lines 402 and 412 represent modeled inclination. The modeled inclination shown at 402 is based on a well path derived from the definitive survey points (obtained using the methodology of the present invention). The modeled inclination shown at 412 is based on a well path derived using only the static surveys. In the exemplary embodiment shown, each of the static surveys points 406 is taken as a definitive survey (the invention is explicitly not limited in this regard). It will be appreciated that additional definitive survey points may be added (as shown at 410) to provide a better fit with the dynamic inclination data (i.e., to reduce the error signal). Static surveys may also be removed and/or adjusted as necessary to obtain a still better fit. It is often desirable to consult a drilling operator's run sheet when adding to or changing the static surveys, for example, to determine the measured depths at which various drilling parameters have been changed. Such changes in drilling parameters may include, for example, a change in weight on bit or a change from sliding mode to rotating mode.

Although the present invention and its advantages have been described in detail, it should be understood that various changes, substitutions and alternations can be made herein without departing from the spirit and scope of the invention.

I claim:

1. A method for obtaining a list of survey points for a subterranean borehole while drilling, the list defining a well path and including a plurality of survey points at a corresponding plurality of measured depths, each survey point including at least one of a borehole inclination and a borehole azimuth, the method comprising:

(a) deploying a drill string in a drilling well;

(b) estimating at least one of a borehole inclination and a borehole azimuth of the drilling well at a particular measured depth;

(c) processing the at least one of the borehole inclination and borehole azimuth estimated in (b) to calculate a value of at least one parameter at the measured depth;

(d) measuring a value of the parameter at substantially the measured depth;

(e) adjusting at least one of the borehole inclination and the borehole azimuth estimated in (b) to obtain a survey point, the survey point selected so that a difference between the value of the parameter calculated in (c) and the value of the parameter measured in (d) is less than a predetermined threshold; and (f) recording the survey point in the list of survey points.

2. The method of claim 1, wherein the parameter measured in (d) is selected from the group consisting of a borehole inclination, a borehole azimuth, a magnetic vector, a component of a magnetic vector, a gravity vector, a component of a gravity vector, a least distance vector between first and second wells, a turn rate, a build rate, and a dogleg severity.

3. The method of claim 1, wherein the at least one of the borehole inclination and borehole azimuth are estimated in (b) via at least one of an extrapolation from a previous survey point, gravity sensor measurements, magnetic field sensor measurements, and an historical survey of a target well.

4. The method of claim 1, wherein the borehole azimuth is adjusted in (e) such that a difference between first and second least distance vectors between the drilling well and a target well is less than the predetermined threshold, the first least distance vector between the drilling well and the target well calculated in (c) and the second least distance vector between the drilling well and the target well obtained in (d).

5. The method of claim 1, wherein the parameter is a magnetic field and the borehole azimuth is adjusted in (e) such that a difference between the magnetic field calculated in (c) and the magnetic field measured in (d) is less than a predetermined threshold.

6. The method of claim 1, wherein the borehole azimuth is adjusted in (e) such that a difference between first and second sets of values of an axial component of at least one of a magnetic field and a gravitational field is less than the predetermined threshold, the first set of values calculated in (c), the second set of values measured dynamically during drilling in (d).

7. The method of claim 1, wherein:

(c) further comprises processing the at least one of the borehole inclination and borehole azimuth estimated in (b) to obtain a calculated value for each of a plurality of parameters at the measured depth;

(d) further comprises measuring a value for each of the plurality of parameters at substantially the measured depth; and (e) further comprises adjusting at least one of the borehole inclination and the borehole azimuth estimated in (b) to obtain a survey point, the survey point selected so that differences between each of the parameter values calculated in (c) and the corresponding values measured in (d) are less than corresponding predetermined thresholds.

8. The method of claim 1, wherein (e) further comprises adjusting at least one of the borehole inclination and the borehole azimuth estimated in (b) to obtain a survey point, the survey point selected so that a fit is obtained between the parameter value calculated in (c) and the corresponding value measured in (d) at a plurality of measured depths.

9. The method of claim 1, wherein (e) further comprises adjusting at least one of a borehole inclination and a borehole azimuth from a previous survey point so that the difference between the value of the parameter calculated in (c) and the value of the parameter measured in (d) is less than the predetermined threshold.

10. A method for obtaining a list of survey points for a subterranean borehole while drilling, the list defining a well path and including a plurality of survey points at a corresponding plurality of measured depths, each survey point including at least one of a borehole inclination and a borehole azimuth, the method comprising:

(a) deploying a drill string in a drilling well, the drill string including at least one survey sensor;

(b) estimating at least one of a borehole inclination and a borehole azimuth of the drilling well;

(c) acquiring first and second comparable quantities, the first and second quantities derived using different considerations, the first quantity derived using the at least one of the borehole inclination and the borehole azimuth estimated in (b);

(d) comparing the first and second comparable quantities to obtain an error signal;

(e) adjusting at least one of the borehole inclination and the borehole azimuth estimated in (b) to obtain a survey point, the survey point selected so that a difference between the comparable quantities is less than a predetermined threshold; and (f) recording the survey point in the list of survey points.

11. The method of claim 10, wherein the second comparable quantity is a sensor measurement.

12. The method of claim 10, wherein the second comparable quantity is derived directly from a sensor measurement.

13. A method for determining a list of survey points for a drilling well based on magnetic ranging measurements of magnetic flux emanating from a target well, the target well being magnetized such that it includes a substantially periodic pattern of opposing north-north (NN) magnetic poles and opposing south-south (SS) magnetic poles spaced apart along a longitudinal axis thereof, the method comprising:

(a) deploying a drill string in the drilling well, the drill string including a magnetic sensor in sensory range of magnetic flux emanating from the target well;

(b) estimating a borehole inclination and a borehole azimuth of the drilling well;

(c) processing the borehole inclination and the borehole azimuth estimated in (b) to calculate a modeled magnetic field at the magnetic sensor;

(d) measuring a magnetic field with the magnetic sensor;

(e) adjusting at least one of the borehole inclination and the borehole azimuth estimated in (b) to obtain a survey point, the survey point selected so that a difference between the modeled magnetic field calculated in (c) and the magnetic field measured in (d) is less than a predetermined threshold; and (f) recording the survey point in the list of survey points.

14. The method of claim 13, wherein the at least one of the borehole inclination and borehole azimuth are estimated in (b) via at least one of an extrapolation from a previous survey point, gravity sensor measurements, magnetic field sensor measurements, and an historical survey of a target well.

15. The method of claim 13, wherein the magnetic field is measured dynamically during drilling in (d).

16. The method of claim 13, wherein (e) further comprises adjusting the borehole azimuth estimated in (b) to obtain a survey point, the survey point selected so that a difference between the modeled magnetic field calculated in (c) and the magnetic field measured in (d) is less than the predetermined threshold at a plurality of measured depths.

17. The method of claim 13, wherein (c) further comprises processing the borehole inclination and the borehole azimuth estimated in (b) to calculate a geometric least distance vector between the drilling well and the target well;

(d) further comprises processing the measured magnetic field to calculate a magnetic least distance vector; and (e) further comprises adjusting the borehole azimuth estimated in (b) to obtain a survey point, the survey point selected so that a difference between the geometric least distance vector calculated in (c) and the magnetic least distance vector calculated in (d) is less than a predetermined threshold.

18. The method of claim 17, wherein:

the geometric least distance vector and the magnetic least distance vector each comprise a high side distance and a right side distance; and (e) further comprises adjusting the borehole azimuth estimated in (b) to obtain a survey point, the survey point selected so that differences between (i) said geometric and magnetic high side distances and (ii) said geometric and magnetic right side distances are less than predetermined thresholds.

19. The method of claim 17, wherein (e) further comprises adjusting the borehole azimuth estimated in (b) to obtain a survey point, the survey point selected so that a fit is obtained at a plurality of measured depths between (i) the modeled magnetic field calculated in (c) and the magnetic field measured in (d) and (ii) the geometric least distance vector calculated in (c) and the magnetic least distance vector calculated in (d).

20. The method of claim 13, wherein (c) further comprises processing the borehole inclination and the borehole azimuth estimated in (b) to calculate a geometric axial position of a point on the drilling well relative to a point on the target well;

(d) further comprises processing the measured magnetic field to calculate a magnetic axial position of the point on the drilling well relative to the point on the target well; and (e) further comprises adjusting the borehole azimuth estimated in (b) to obtain a survey point, the survey point selected so that a difference between the geometric axial position calculated in (c) and the magnetic axial position calculated in (d) is less than a predetermined threshold.

21. The method of claim 13, wherein (c) further comprises processing the borehole inclination and the borehole azimuth estimated in (b) to calculate a well path of the drilling well and further processing the well path of the drilling well, an historical well path of the target well, and a magnetic model of the target well to calculate the modeled magnetic field at the magnetic sensor.

22. The method of claim 13, wherein step (e) comprises a manual implementation.

23. The method of claim 13, wherein step (e) comprises an automated implementation.

24. The method of claim 13, wherein (e) further comprises adjusting at least one of a borehole inclination and a borehole azimuth from the list of survey points so that the difference between the modeled magnetic field calculated in (c) and the magnetic field measured in (d) is less than the predetermined threshold.

25. A method for determining the well path of a drilling well based on magnetic ranging measurements of magnetic flux emanating from a target well, the target well being magnetized such that it includes a substantially periodic pattern of opposing north-north (NN) magnetic poles and opposing south-south (SS) magnetic poles spaced apart along a longitudinal axis thereof, the method comprising:

(a) deploying a drill string in the drilling well, the drill string including a magnetic sensor in sensory range of magnetic flux emanating from the target well;

(b) estimating a borehole inclination and a borehole azimuth of the drilling well;

(c) processing the borehole inclination and the borehole azimuth estimated in (b) to calculate a modeled magnetic field at the magnetic sensor and a geometric least distance vector between the drilling well and the target well;

(d) measuring a magnetic field with the magnetic sensor;

(e) processing the magnetic field measured in (d) to calculate a magnetic least distance vector between the drilling well and the target well;

(f) adjusting the borehole azimuth estimated in (b) to obtain a survey point, the survey point selected so that a fit is obtained at a plurality of measured depths (i) between the modeled magnetic field calculated in (c) and the magnetic field measured in (d) and (ii) between the geometric least distance vector calculated in (c) and the magnetic least distance vector calculated in (e); and (g) recording the survey point in the list of survey points.

26. The method of claim 25, wherein (f) further comprises adjusting at least one borehole azimuth from the list of survey points in order to obtain the fit at the plurality of measured depths (i) between the modeled magnetic field calculated in (c) and the magnetic field measured in (d) and (ii) between the geometric least distance vector calculated in (c) and the magnetic least distance vector calculated in (e).

* * * * *